US007506764B2

(12) United States Patent
Couture

(10) Patent No.: US 7,506,764 B2
(45) Date of Patent: Mar. 24, 2009

(54) APPARATUS AND METHOD FOR SEPARATING/MIXING PARTICLES/FLUIDS

(76) Inventor: Michel Couture, 360 Terrasse Robillard, St-André d'Argenteuil, Québec (CA) J0V 1X0

( * ) Notice: Subject to any disclaimer, the term of this patent is extended or adjusted under 35 U.S.C. 154(b) by 0 days.

(21) Appl. No.: 10/776,176

(22) Filed: Feb. 12, 2004

(65) Prior Publication Data

US 2004/0159587 A1 Aug. 19, 2004

(30) Foreign Application Priority Data

Feb. 12, 2003 (CA) ..... 2421246
Feb. 21, 2003 (CA) ..... 2419451
Jul. 18, 2003 (CA) ..... 2435086

(51) Int. Cl.
*B07B 9/00* (2006.01)
*B07B 4/00* (2006.01)
*B07B 7/00* (2006.01)

(52) U.S. Cl. ..... 209/21; 209/639; 209/134

(58) Field of Classification Search ..... 209/19–21, 209/24, 25, 32, 33, 44.2, 644, 638, 639, 133, 209/134, 135

See application file for complete search history.

(56) References Cited

U.S. PATENT DOCUMENTS 197,897 A * 12/1877 Rice ..... 209/135

(Continued)

FOREIGN PATENT DOCUMENTS

CA 2068935 11/1992

(Continued)

OTHER PUBLICATIONS

*Particle Size Control*, as available on British Rema website, www.britishrema.com.

(Continued)

*Primary Examiner*—Patrick H Mackey
*Assistant Examiner*—Mark Hageman

(57) ABSTRACT

An apparatus and method for separating a particle stream into particle groups and treating a particle stream, comprising a dilution treatment chamber defining an upstanding passageway to receive a particle stream, such that the particle stream falls toward a first-particle-group outlet in the dilution treatment chamber. A transfer chamber casing is adjacent and interconnected to the dilution treatment chamber, and defines a transfer chamber to receive second particle group Second-particle-groups outlets of the transfer chamber are laterally positioned with respect to the passageway and allow jet fluid communication there between. A distributor in the passageway is provided to spread out the particle stream and to distribute the particle stream over a surface area of the dilution treatment chamber. Fluid flow apertures create a fluid flow between the transfer chamber and the passageway of the dilution treatment chamber so as to project/entrain second particle group to the transfer chamber with a first particle group remaining in the dilution treatment chamber for exiting through the first-particle-group outlet of the dilution treatment chamber. The apparatus and method is also used to treat particle streams/fluids. A method and device for separating/treating a stream of particles having a cross sectional area, the stream of particles flowing substantially along a stream flow direction. The method includes: directing a flow of fluid towards the stream of particles, the flow of fluid flowing substantially along a flow of fluid direction, the flow of fluid having a pressure and magnitude such that the velocity produce a jet of the fluid producing a force imparting on the particles causing the particles to move in a direction substantially parallel to the flow of fluid thereby increasing the cross sectional area and diluting the previous mass of the particles stream, and the separating/treating, particles/fluids.

13 Claims, 10 Drawing Sheets

U.S. PATENT DOCUMENTS

| | | | | | |
|---|---|---|---|---|---|
| 321,552 | A | * | 7/1885 | Wakeford | 209/134 |
| 339,723 | A | * | 4/1886 | Winkler | 209/262 |
| 366,923 | A | * | 7/1887 | Butler | 209/135 |
| 818,944 | A | * | 4/1906 | Eaches | 209/33 |
| 1,348,043 | A | * | 7/1920 | Parkinson | 209/135 |
| 1,506,494 | A | * | 8/1924 | Lindsay | 209/137 |
| 1,792,962 | A | * | 2/1931 | Barker | 209/135 |
| 2,003,899 | A | * | 6/1935 | Nesbit | 209/137 |
| 2,210,103 | A | * | 8/1940 | Stoner | 209/31 |
| 2,222,861 | A | * | 11/1940 | Stoner | 209/135 |
| 2,255,206 | A | * | 9/1941 | Duncan | 65/506 |
| 2,389,966 | A | * | 11/1945 | Erickson | 209/25 |
| 2,441,724 | A | * | 5/1948 | Simpson | 208/152 |
| 2,493,218 | A | * | 1/1950 | Bergstrom | 208/152 |
| 2,634,858 | A | * | 4/1953 | Vahey et al. | 209/20 |
| 2,828,011 | A | * | 3/1958 | Whitby | 209/20 |
| 3,044,619 | A | * | 7/1962 | Knolle | 209/33 |
| 3,055,597 | A | * | 9/1962 | Mund | 241/49 |
| 3,701,420 | A | * | 10/1972 | Satake | 209/135 |
| 3,720,307 | A | * | 3/1973 | Hukki | 209/10 |
| 4,848,590 | A | * | 7/1989 | Kelly | 209/564 |
| 5,259,510 | A | * | 11/1993 | Lowe et al. | 209/134 |
| 5,464,100 | A | * | 11/1995 | Oka | 209/31 |
| 5,934,477 | A | * | 8/1999 | Smith | 209/33 |
| 2004/0035759 | A1 | * | 2/2004 | Kokko | 209/154 |
| 2004/0035763 | A1 | * | 2/2004 | Kokko | 209/638 |

FOREIGN PATENT DOCUMENTS

| | | |
|---|---|---|
| CA | 2294829 | 1/1999 |
| CA | 2257674 | 1/2003 |
| DE | 878149 | 6/1953 |
| DE | 1 482 455 | 5/1970 |
| DE | 1482455 | 5/1970 |
| FR | 324 817 | 4/1903 |
| FR | 324817 | 4/1903 |

OTHER PUBLICATIONS

*Marsulex Classifiers: Operating Principles and Efficiency*, as issued by Marsulex Environmental Technologies.

Literature on classifiers obtained from the website of Buell Division of Fisher-Klosterman, Inc., www.fkinc.com.

*Particle Classification: Making the Grade*, as published in Chemical Engineering, Apr. 2002.

* cited by examiner

APPARATUS AND METHOD FOR SEPARATING/MIXING PARTICLES/FLUIDS

This application claims priority on Canadian Patent Applications No. 2,421,246, filed on Feb. 12, 2003, No. 2,419,451, filed on Feb. 21, 2003, and No. 2,435,086, filed on Jul. 18, 2003.

BACKGROUND OF THE INVENTION

1. Field of the Invention

The present invention generally relates to the separation and mixing, of particles and, more specifically, to a dry particle stream separator/mixer and methods for separating particle streams into particle groups and for mixing/treating particle groups.

2. Background Art

Previously known techniques and methods are currently used for the separation of aggregates into particle groups. For instance, gravity classifiers, inertial classifiers, centrifugal classifiers, and cyclone separators are well known and used technologies. Amongst other patents, Canadian Patent No. 2,257,674, issued on Jan. 7, 2003 to Cordonnier et al., discloses an air classifier with centrifugal action. Canadian Patent Applications No. 2,068,935 (by Tyler et al.) and 2,294,829 (by Gruenwald) respectively describe an air separator and an air classification of water-bearing fruit and vegetable ingredients for peel and seed removal and size discrimination.

Another known separation method is gravity separation by elutriation. In this process, a predetermined particle group is lifted by airflow against the force of gravity. A finer particle group is collected by an upwardly positioned collector, whereas coarser particles overcome the airflow to be collected at a downwardly positioned collector. The velocity of air has a direct effect on the particle group that is collected by the upwardly positioned collector.

This previously described method is a dry process, in that the fluid used for the separation is not in a liquid phase. Such systems are advantageous in that no liquid is polluted in the separation process. The cleaning of liquids after particle separation is a costly process, and this results in a clear cost-efficiency advantage for dry processes.

SUMMARY OF INVENTION

It is therefore an aim of the present invention to provide a novel apparatus and method for separating a particle stream into particle groups.

It is a further aim of the present invention to cause a dilution of a particle stream and is related to enhance the separation of the particle stream into particle groups.

It is a further aim of the present invention to provide a novel apparatus and method for mixing a particle groups into a particle stream.

It is a further aim of the present invention that the apparatuses for separating a particle stream into particle groups, and for mixing particle groups into a particle stream use minimum space and air volume so as to be cost and space efficient.

It is a further aim of the present invention to provide a novel apparatus and method for separating particle streams into particle groups.

It is a further aim of the present invention to reduce a need for conventional dust collection systems.

A few factors are considered in creating separation, mixing equipment. For instance, it is desired that the amount of fluid used in the process be kept low. The fluid that is used for the separation, will lose the particles it carries for settling.

Also, the separation is a sub-process of larger processes, and is often performed in limited-space areas with the larger process. It is therefore desired to keep the dry-separation equipment as space efficient as possible.

Therefore, and non-restrictively, in accordance with the present invention, there is provided an apparatus for separating a particle stream into particle groups and treating a particles stream. The apparatus includes a dilution treatment chamber 12, defining for instance a parallelepipedic upstanding passageway (20), dilution treatment chamber 12, having a particle inlet 21, at a top end, and a first-particle group outlet at a bottom end, the dilution treatment chamber 12, being adapted to receive a particle stream at the inlet 21, such that the particle stream falls toward the dilution treatment chamber and first particle group outlet 22; a transfer chamber casing 13, for instance parallelepipedic and adjacent to the dilution treatment chamber 12, and defining a transfer chamber 30, adapted to receive the second particle group separated from the particle stream; a transfer chamber 13, sharing a wall 23, with the dilution treatment chamber 12; at least one transfer aperture 24, second particle group outlet laterally positioned with respect to the dilution treatment chamber 12, and allowing fluid communication between the longitudinal dilution treatment chamber 12, and the longitudinal transfer chamber 13; a distributor 14, in passageway of the dilution treatment chamber 12, and at least one nozzle 14, situated between the particle stream inlet 25, and at least one transfer aperture 24, second particle-group outlet for spread out, breaking down the particle stream and distributing the particle stream over a surface area of the dilution treatment chamber 12, and; at least one dilution treatment chamber fluid flow aperture (25) in the dilution treatment chamber 12, and below the distributor 14, adapted to create a lateral fluid flow jet between the dilution treatment chamber 12, and the transfer chamber 13, so as to impact and entrain a second particle group, from the passageway of the dilution treatment chamber and to project the selected particles groups away through the transfer aperture 24, and second-particle group outlet to the transfer chamber outlet 31, with a first-particle-group remaining in the dilution treatment chamber 12, and exiting through the dilution treatment chamber, first-particle-group outlet 22, the apparatus being adapted to be connected to a positive pressure source to create the fluid flow stream.

Still further in accordance with the present invention, there is provided an apparatus for at least treating particle and/or fluid stream, comprising a generally parallelepipedic dilution treatment chamber 12, defining a parallelepipedic upstanding passageway 20, having an inlet 21, at a top end, and an outlet 22, at a bottom end, the passageway 20, being adapted to receive said particle and/or fluid streams at the inlet such that said particle and/or streams fall toward the outlet; at least one dilution treatment chamber fluid flow aperture 25 connected to the nozzle outlet having an adjustable cross section area, in the dilution treatment chamber 12, adapted to create a generally lateral flow of at least one of a fluid jet and particle jet within the passageway 20, enhancing separation and to create a turbulence in the passageway 20, for at least one of mixing said particle and/or fluid streams and treating said particle and/or fluid streams, whereby a mixture and/or treated matter will exit the passageway 20, at the outlet 22; and a positive pressure source connected to the nozzle which is connected to the dilution treatment chamber fluid flow aperture to create the lateral flow of the at least one of the fluid and the particle jet.

Still further in accordance with the present invention, there is provided a method for at least one of treating particle and/or fluid streams, comprising the steps of: i) vertically diluting particle and/or fluid streams by directing particle and/or fluid streams to a falling condition; ii) creating a lateral flow of fluid and/or a particle jet force across the particle and/or fluid streams in said falling condition for at least one of treating the particle and/or fluid streams by a turbulence resulting from the lateral flow of fluid and/or particle jet stream, and treating said particle and/or fluid streams; and iii) collecting the treated matter below the lateral flow.

In some embodiments of the invention, the method and apparatus lets the particles decelerate, agglomerate and settle in the transfer chamber 13, and exiting by the transfer chamber outlet 31.

Advantageously, the claimed apparatus is able to process relatively large quantities of particles relatively fast.

BRIEF DESCRIPTION OF THE DRAWINGS

Having thus generally described the nature of the invention, reference will now be made to the accompanying drawings, showing by way of illustration a preferred embodiment thereof and in which.

DESCRIPTION OF THE PREFERRED EMBODIMENTS

It is pointed out that the present invention is associated with the separating or mixing. The term "particles stream" is broadly used herein to designate a different component mass of particles, granules, pellets, and other elements of different mass and volume gathered together. Various uses of the present invention are defined hereinafter, for which the components masses which are separated/treated is referred to as particle stream, unless stated otherwise.

Figure 1:
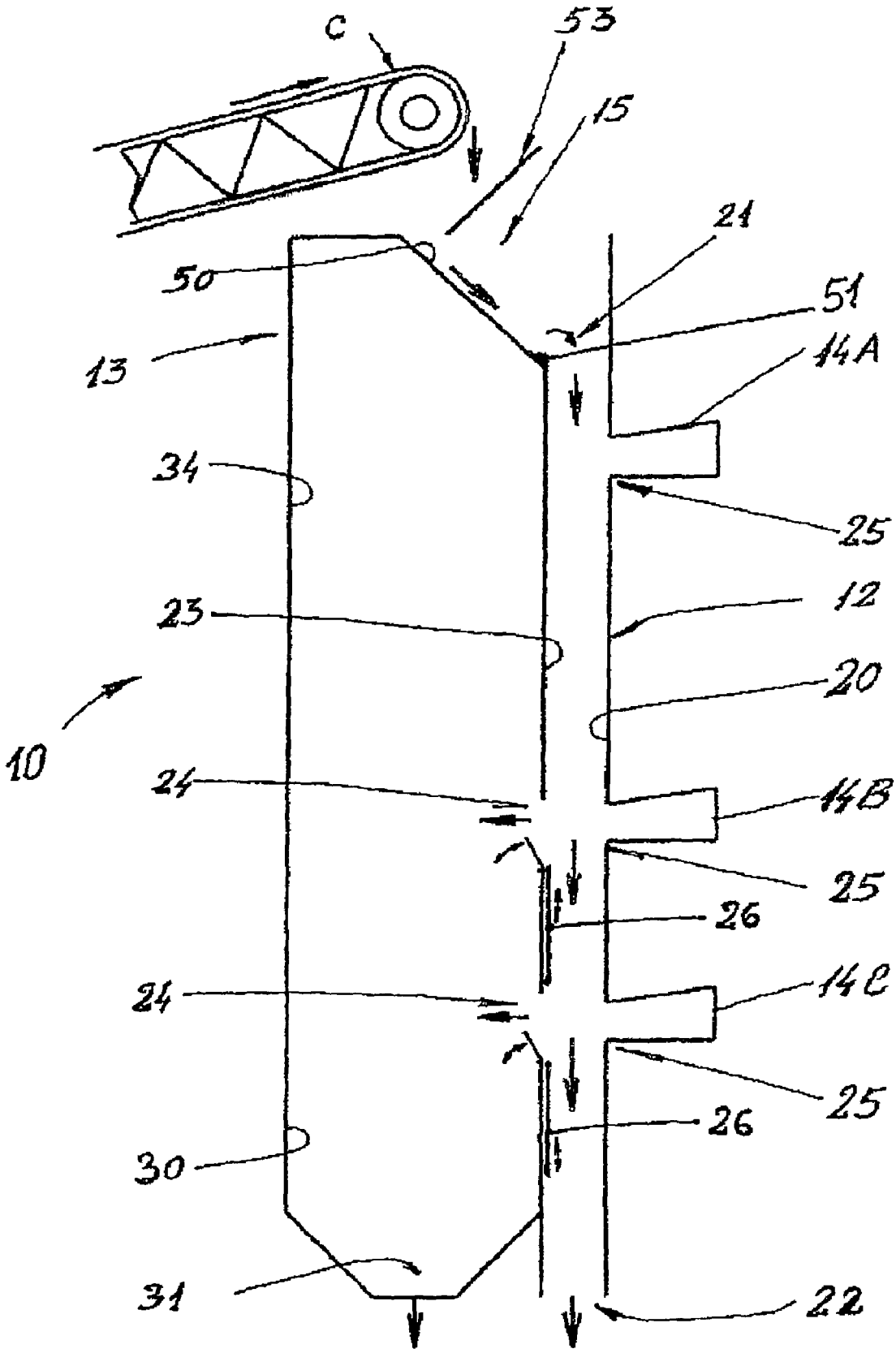
FIG. 1 is a schematic view of an apparatus for separating/treating a particle stream in accordance with a preferred embodiment of the present invention, and of a method for separating/treating the particles stream.

Referring to the drawings, and more particularly to FIG. 1, an apparatus for separating/treating a particle stream into particle groups is generally shown at 10. The apparatus 10, shown in the drawings is a typical apparatus according to the invention. The reader skilled in the art will readily appreciate that many other geometric shapes and configurations are within the scope of the invention. The apparatus 10, has a substantially parallelipipedic dilution transfer chamber 12, a substantially parallelipipedic transfer chamber 13 adjacent to the dilution treatment chamber 12, sharing a wall 23, between the transfer chamber 13 and the dilution treatment chamber 12, a nozzles 14 serially mounted on the dilution treatment chamber 12, and a pre-treatment module 15. It is pointed out that the nozzles 14 are affixed with letters in various figures, whereby reference to the nozzles 14 will relate to all nozzles (e.g., nozzles 14A, 14B and 14C), while reference to a specific one of the nozzles will include an affixed letter.

The dilution treatment chamber 12 performs a dilution of a particle stream by gravity, hosts a step of separation/ of the particle stream into particle groups.

The transfer chamber casing 13 is in fluid communication with the dilution treatment chamber 12 and receives particle group separated from the remainder of the particle stream in the dilution treatment chamber 12.

The nozzles 14 are used to inject project fluid, which distributes the mass of particle stream and/or enhance the dilution of the particle stream in the dilution treatment chamber 12. Moreover, the nozzles 14 are used to inject/project fluid jet which separates particle stream into the particle groups, and treating particles stream.

The pre-treatment module 15 is used to guide and-accelerate the particle stream toward the dilution treatment chamber 12, such that the particle stream will have predetermined velocity. The velocity will cause a dilution of the particle stream.

Dilution Treatment Chamber 12

Figure 2:
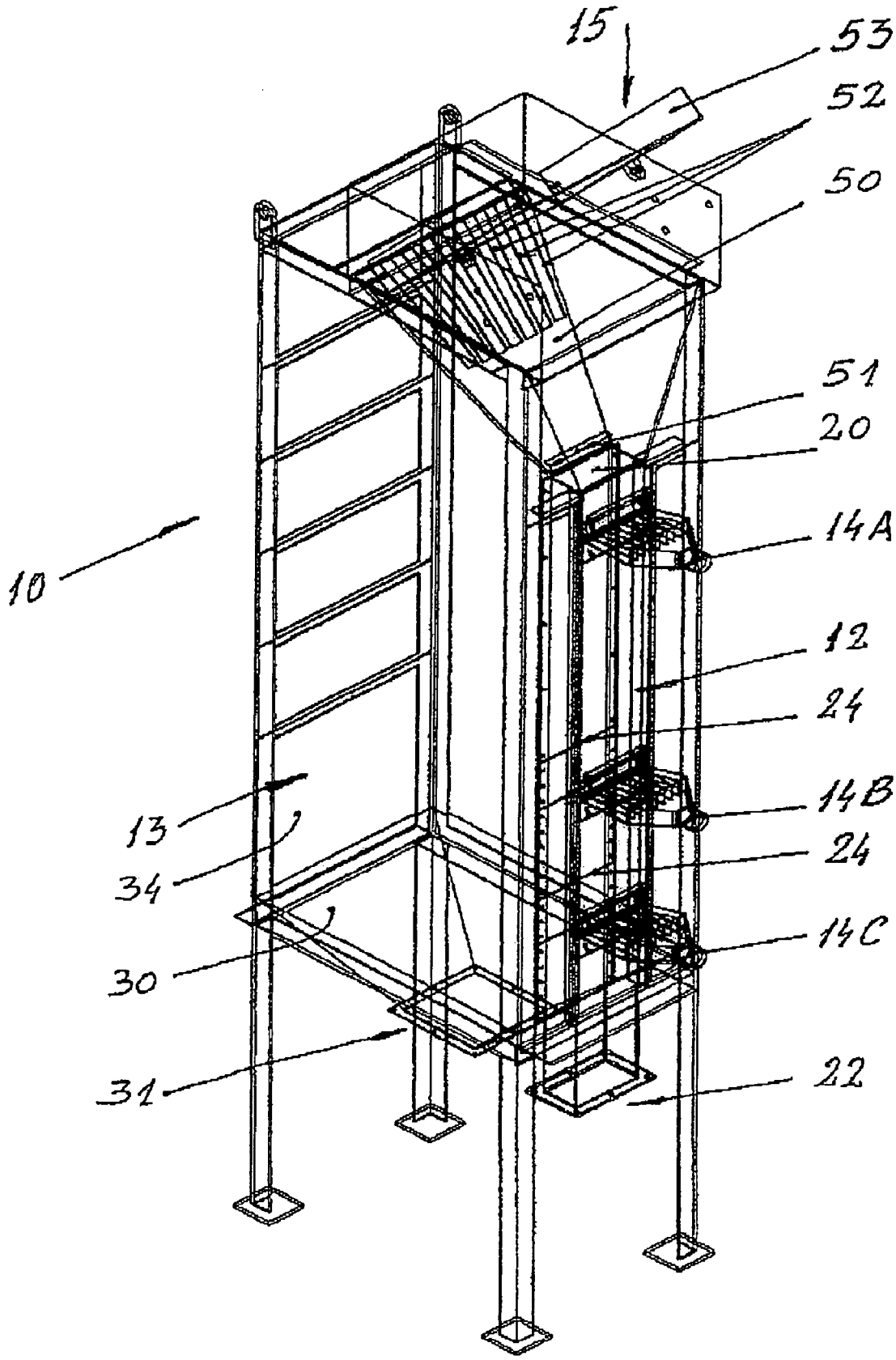
FIG. 2 is a perspective view of the apparatus in accordance with a preferred embodiment of the present invention.
Figure 3:
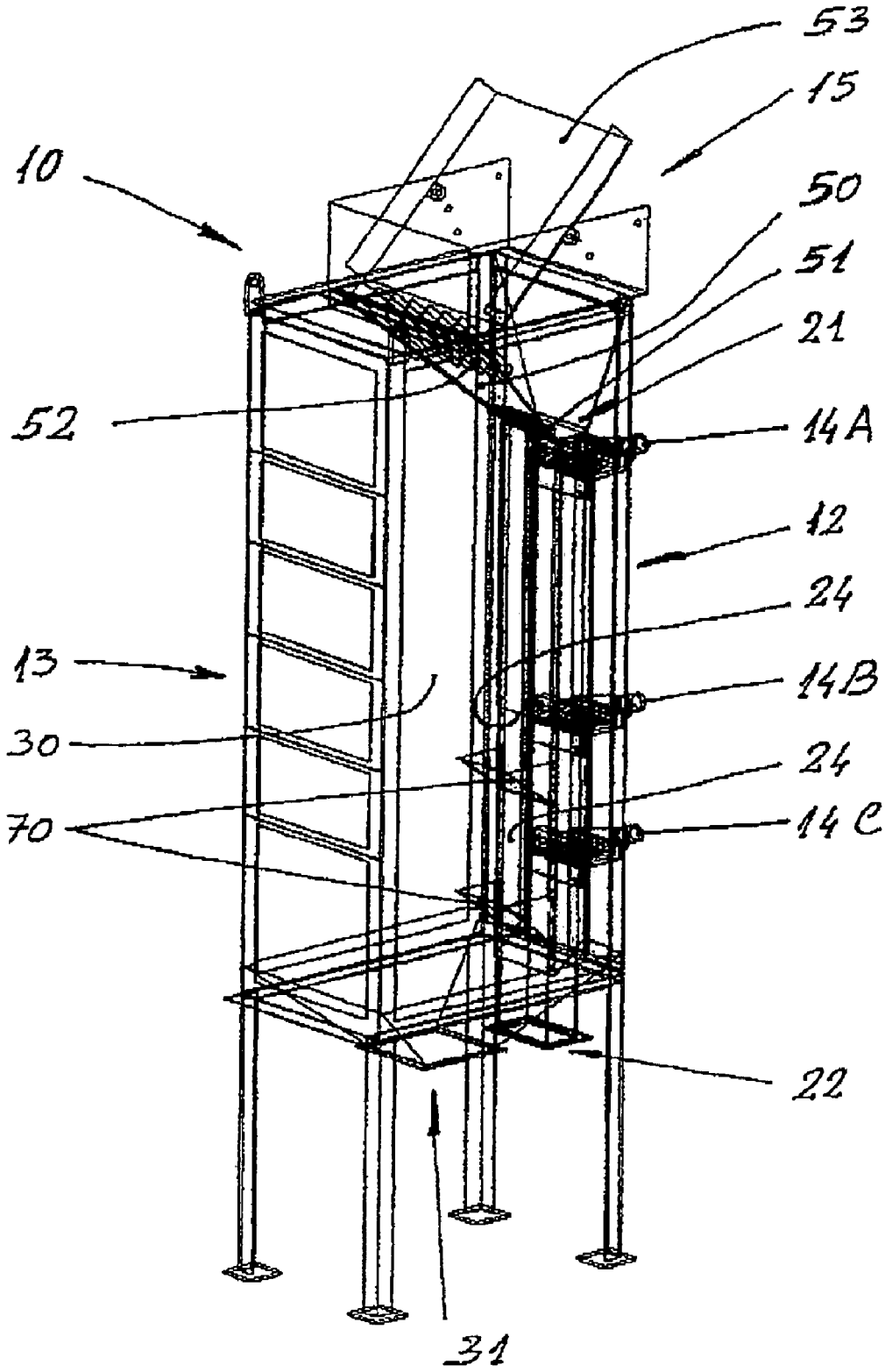
FIG. 3 is a further perspective view of the apparatus of FIG. 1.

Referring concurrently to FIGS. 1, 2 and 3, the typically parallelepipedic dilution treatment chamber 12 is shown having an upstanding elongated shape, and defines a substantially elongated passageway 20 having a passageway cross-section Although a passageway cross-section, is described, any other suitable cross-section shapes are contemplated. The passageway 20 has an inlet 21 at a top end thereof and an outlet 22 at a bottom end thereof. The dilution treatment chamber 12 shares a wall 23 with the preferably parallelepipedic transfer chamber casing 13. Transfer apertures 24, positioned opposite the dilution treatment chamber fluids aperture 25, are provided in the wall 23, such that the dilution treatment chamber 12 and the transfer chamber casing 13, are in fluid communication. Moreover, the dilution treatment chamber 12 may vary in cross-sectional dimensions. For instance, appropriate translating mechanisms may be provided so as to increase/decrease a length or width of the cross-section parameters of the dilution treatment chamber 12.

The dilution treatment chamber 12 also has pressure-differential apertures 25 (herein three apertures, i.e., dilution treatment chamber fluid flow apertures), two of which are horizontally positioned opposite the transfer aperture 24 in the wall 23, between the dilution chamber 12 and transfer chamber casing 13.

Transfer Chamber 13

Referring concurrently to FIGS. 1, 2 and 3, the transfer chamber casing 13 defines an inner transfer chamber 30. The inner transfer chamber 30 has a funnel-shaped outlet 31 at a bottom end thereof, so as to collect a particle group and allow deceleration and mass reconcentration for settling in the transfer chamber 30.

Figure 5:
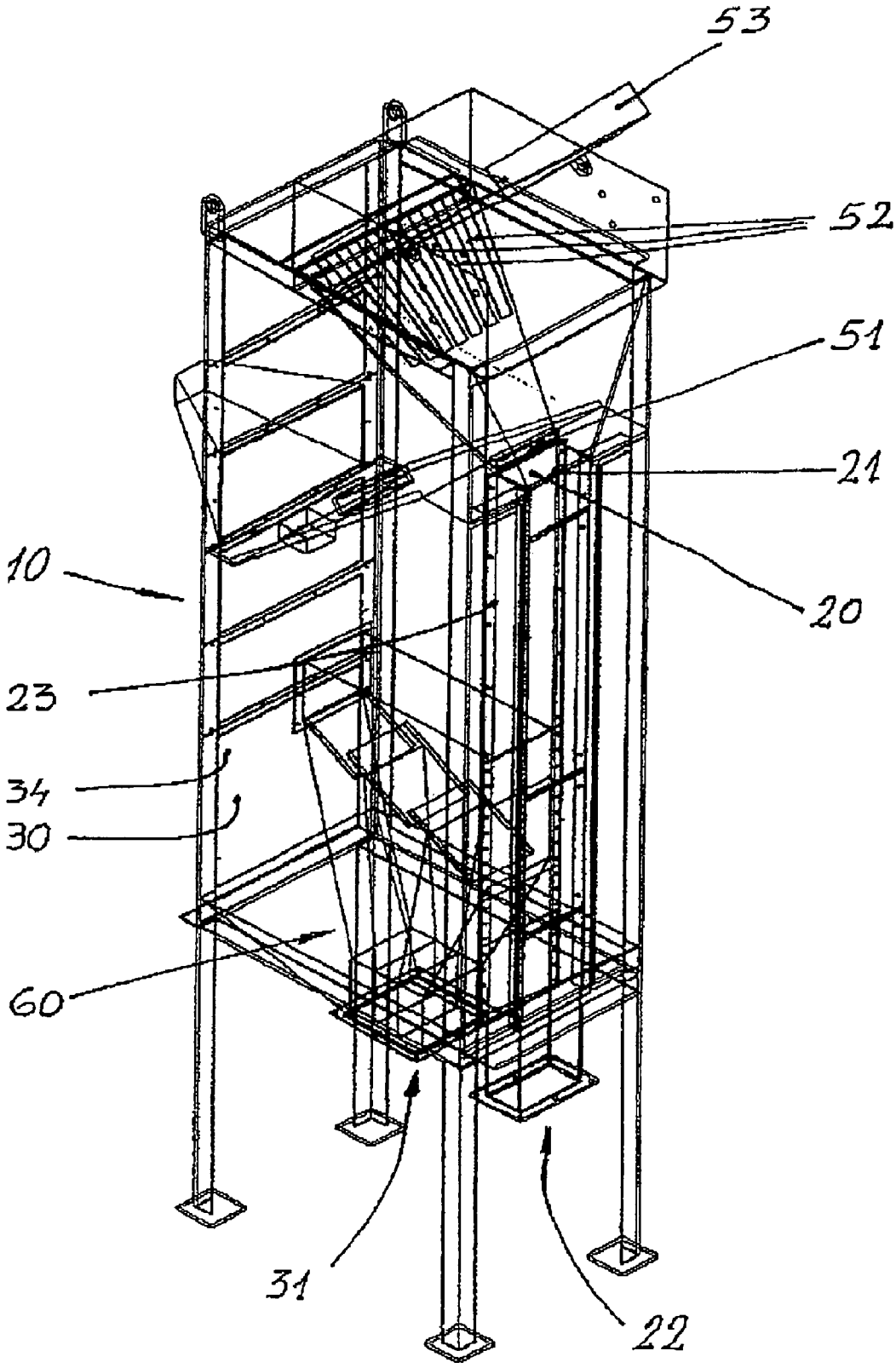
FIG. 5 is a perspective view of the apparatus in accordance with a second embodiment of the present invention.

Referring to FIG. 5, a lateral particle separator 60, in accordance with another embodiment of the present invention, is received in the inner transfer chamber 30 of the transfer chamber casing 13. The lateral particle separator 60 will be described in further detail hereinafter, and is used to cause a further particle group separation.

Nozzle 14

Referring concurrently to FIGS. 1, 2 and 3, the nozzle 14B and 14C are positioned opposite the transfer aperture 24 of the dilution treatment chamber 12. The nozzle 14, may take various geometric shape and configurations. For instance, the nozzle configuration are connected to a pressure source so as to produce and project, inject a gaseous fluid (e.g., air or any other suitable gas, whereby reference will be made non-restrictively hereinafter to air or gaseous fluid) into the passageway 20 of the dilution treatment chamber 12.

Figure 4:
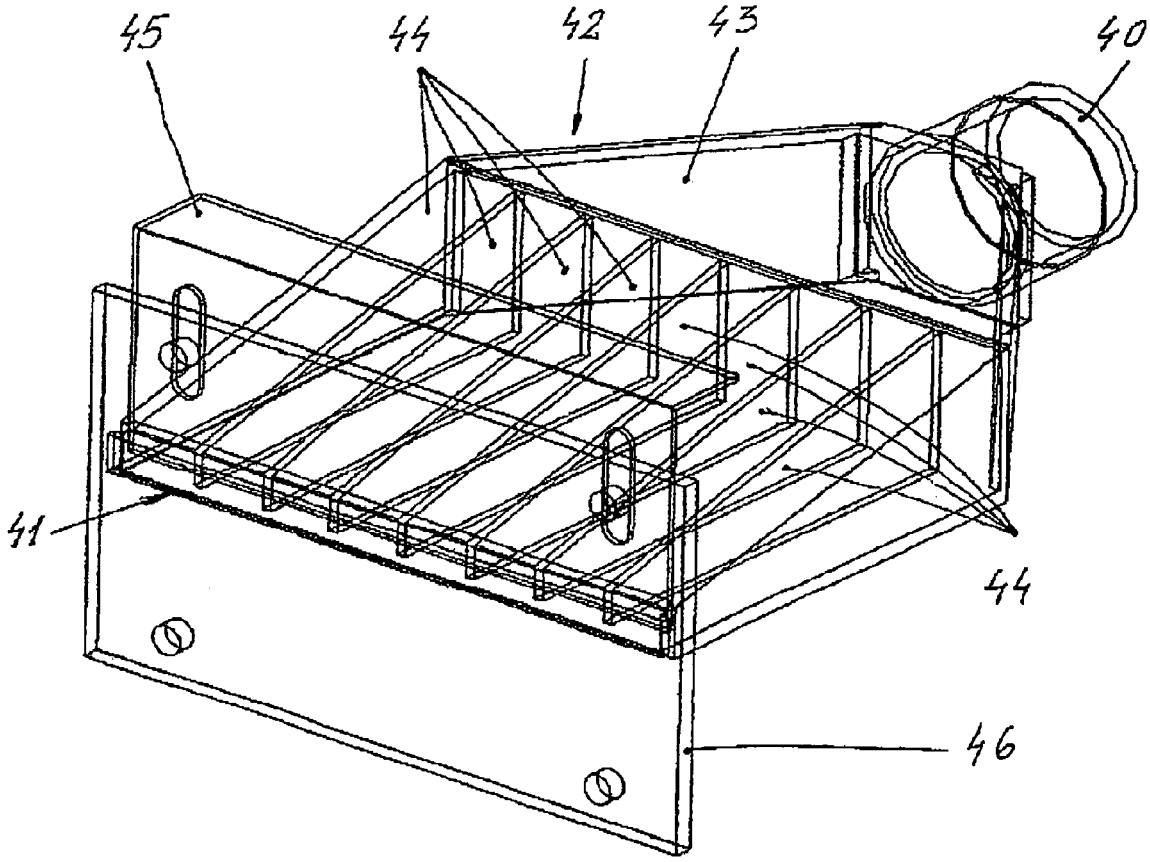
FIG. 4 is a perspective view of a nozzle to be used with the apparatus of the first embodiment.

Referring to FIG. 4, one of the nozzle 14 is illustrated in greater detail. The nozzle 14 has an inlet 40, by which it is connected to a pressure source, and an outlet 41 of elongated shape. The nozzle 14 has a diffusing body 42 between the inlet 40 and the outlet 41.

In a preferred embodiment of the present invention, the diffusing body 42 has an accumulator portion 43 connected to the inlet 40, and tapered diffusing sectors 44 between the accumulator portion 43 and the outlet 41. The diffusing sectors 44 are used in order to create a substantially uniform diffusion of fluid out of each of the nozzle 14.

A gate 45 is displaceable vertically for the adjustment of the height of the outlet and surface area of the nozzle outlet opening 41. A connection flange 46 is used to secure the nozzle 14 to the dilution treatment chamber 12 opposite the pressure-differential apertures 25. It is also seen in FIGS. 2 and 3 that the gate 45 can be accessed from an exterior of the apparatus 10, thereby enabling the rapid adjustment of the outlet size of the nozzle 14 from an exterior of the apparatus 10.

The above-described configuration of the nozzle 14 enables a high-pressure, low-volume output of gaseous fluid into the dilution treatment chamber 12 to produce a high impact on the particles stream.

Accordingly, the output of gaseous fluid will decelerate at a high rate, so as to project and entrain in some instances described hereinafter a given selected particle group out of the dilution treatment chamber 12, and to avoid creating turbulence in the transfer chamber 30. Such turbulence would slow down the settling process in the transfer chamber 13, for instance, if the apparatus 10 were used for classifying particle groups.

Pretreatment Module 15

Referring concurrently to FIGS. 1, 2 and 3, the pre-treatment module 15 is positioned at the inlet 21 of the dilution treatment chamber 12. The pre-treatment module 15 conveys the particle stream from a particle stream source, such as conveyor C, to the inlet 21 of the dilution treatment chamber 12. More specifically, the pre-treatment module 15 will be used to produce specific inlet conditions for the particle stream.

In a preferred embodiment of the present invention, the pre-treatment module 15 has a slide 50, sloping downwardly towards the inlet 21 of the dilution treatment chamber 12. A deflector 51 is positioned between the slide 50 and the inlet 21 of the passageway 20. The deflector 51 has a generally horizontal launch surface, but may also be oriented otherwise. As seen in FIGS. 2 and 3, the slide 50 tapers towards the inlet 21 of the dilution treatment chamber 12, so as to have an outlet 22, width generally equal to the inlet 21, width of the passageway 20 of the dilution treatment chamber 12. The particle stream reaching the slide 50 is preferably uniformly distributed toward the inlet 21 of the dilution treatment chamber 12.

A further slide splitter 53 is optionally provided above the slide 50 so as to dampen the fall of the particle stream from the conveyor C. The slide 53 will absorb a portion of the downward force, and will absorb the lateral velocity transmitted from the conveyor C to the particle stream, such that the particle stream reaches the dilution treatment chamber 12 at predetermined velocity parameters.

It is contemplated to provide various geometry configuration to the pre-treatment module 15. For instance and non restrictively, the slide 50 is herein illustrated as being generally a flat, inclined surface. However, it is contemplated to provide the slide 50 with a downwardly-tapered shape, whose cross-section would meet the inlet 21 of the dilution treatment chamber 12. Moreover, for such an embodiment, the slide 53 preferably has an upright shape.

The Operation of the Apparatus in Separation

Now that the various components of the apparatus 10 have been described, of the apparatus 10 is set forth.

Referring concurrently to FIGS. 1, 2 and 3, a particle stream is fed by the conveyor C to the apparatus 10. The particle stream has a lateral velocity and will accelerate downwardly when leaving the conveyor C due to gravitational forces.

The slide 53 will absorb a portion of the downward force of the particle stream, and stop the lateral velocity of the particle stream that had been transferred to the particle stream by the action of the conveyor C. The mass of particle stream is directed by the slide 53 toward the slide 50 of the pre-treatment module 15, at generally predetermined velocity conditions.

Upon reaching the slide 50, the particle stream will be guided by the guiding rails 52 so as to be conveyed uniformly towards the dilution treatment chamber 12 as a result of the downward slope of the slide 50. The downward slope of the slide 50 will cause the particle stream to accelerate.

The deflector 51, having a launch surface, will deflect the particle stream so as to initiate a break-up of the particles stream. A dilution will be the result of the deflection of the particle stream by the deflector 51. Accordingly, the particle stream will reach the dilution treatment chamber 12, having been subjected to a mass break-up and to a horizontal dilution.

The particles stream then falls in the passageway 20 of the dilution treatment chamber 12. The gravity velocity acceleration will cause a vertical dilution of the particle stream and will multiplies the previous dilution caused by the nozzle 14.

A first one of the nozzles 14, namely nozzle 14A, will inject/air within the dilution-treatment chamber 12, passageway 20, so as to spread out the mass of particle stream into particle groups, dilute and/or creating space between the particles groups. This nozzle 14A is also referred to as a distributor, as it will be distributing the particle stream over a surface area of the dilution treatment chamber dimension 12. As an alternative of nozzle 14, a distributors 14, the apparatus 10 may be provided with vibrating strainers, impellers, or the like, as will be illustrated hereinafter.

The particle stream, having been subjected to a horizontal and a vertical dilution, will be crossing a horizontal flow of air as injected/by at least one others nozzles 14B, and the optional nozzle 14C. The nozzles 14B and 14C inject air, at a predetermined pressure through the dilution treatment chamber fluid aperture 25, which are positioned opposite to the transfer chamber aperture 24, such that the fluid will project particles group selected from the particle stream in the dilution treatment chamber 12 the finer particles carried through the particle stream and/or out of the passageway 20, through the transfer chamber aperture 24, and into the inner transfer chamber 13, in a high ratio of particle to air concentration. The air injected by the nozzles 14 is at the predetermined pressure, such that the other groups of particles have not been projected out and remain in the particle stream depending. In other words, some groups of particles are projected over the dilution treatment chamber distance, which creates a separation of these groups of particles from other particles present in the stream of particles. Particle group will not entrained out of the passageway 20 by the air flow. The dilution that has taken place previously is an important factor for the separation and treating of the different particles. The magnitude of the pressure of air projected/injected will have a direct effect on the particles groups being withdrawn from the particle stream in the dilution treatment chamber 20. It is pointed out that the vertical distance from the inlet 21 to the nozzle 14B is an essential factor in diluting the particle stream to facilitate the subsequent separation/treating of the particle groups so as to increase fluid/particle contact.

Although three nozzles (namely 14A, 14B and 14C) are described, the number of nozzles 14 is variable according to the present invention. The apparatus 10 is operative with a single nozzle 14 opposing an aperture 25, but a plurality of nozzles 14 may be serially added on the dilution treatment chamber 12 to increase the efficiency of the operation taking place within the dilution treatment chamber 12.

Thereafter, the selected particle group exits through the transfer chamber outlet 31 at the bottom of the transfer chamber 30 of the transfer casing 13 after settling, whereas the remaining particle stream particle group continues its drop into the dilution treatment chamber 12 outlet 22.

The Operation of the Apparatus in /Treating

As mentioned previously, the apparatus 10 of the present invention is usable for treating particles and/or fluid streams. Therefore, treating an operation of the apparatus 10 is set forth.

Referring to FIG. 1, particle and/or fluid streams to treat are fed by the conveyor C, and possibly other conveyors or particle and/or fluid sources (not shown) to the apparatus 10. The particle and/or fluid streams have a lateral velocity and will accelerate downwardly when leaving their source due to gravitational forces as similarly set for the separate process, just different force adjustment will take place as described previously.

The particle and/or fluid streams then falls in the passageway 20 of the dilution treatment chamber 12. The gravity will cause a vertical dilution of the particle and/or fluid streams.

A first one of the nozzles, namely nozzle 14A, will laterally project/inject fluid, or any other suitable fluid or particle jet, within the passageway 20 of the dilution treatment chamber 12 so as to cause a movement of components of particle stream for another step of dilution of the particle and/or fluid streams. The fluid/particle injected and projected by the nozzle 14A is of predetermined pressure depending of the adjustment of the pressure source and the nozzle outlet gate 41, to produce the different jet force through the particle stream so as to have a variable effect relative to the size, mass and other characteristics of the streams and/or fluid streams. The nozzle 14 and 14A projects/injects air or any other suitable fluid, at high pressure and low volume.

The opposite transfer chamber apertures 24 are used in the treating process of the apparatus 10. The nozzles 14B and 14C are optionally used with the opposite transfer chamber aperture 24 with a fluid at high pressure 26, so as to create further turbulence, as it is contemplated to provide a plurality of the nozzles 14 to enhance the treating of particle and/or fluid stream in the passageway 20, or for treating the particle and/or fluid streams. Additional nozzles may also be added to the apparatus 10.

Thereafter, the treated matter, resulting from the treatment of the particle and/or fluid streams, continues its drop into the dilution treatment chamber 12 toward the outlet 22.

Additional Components of the Apparatus 10

It is contemplated to provide additional components to the apparatus 10 in order to optimise the separation of the particle stream into particle groups.

Figure 6:
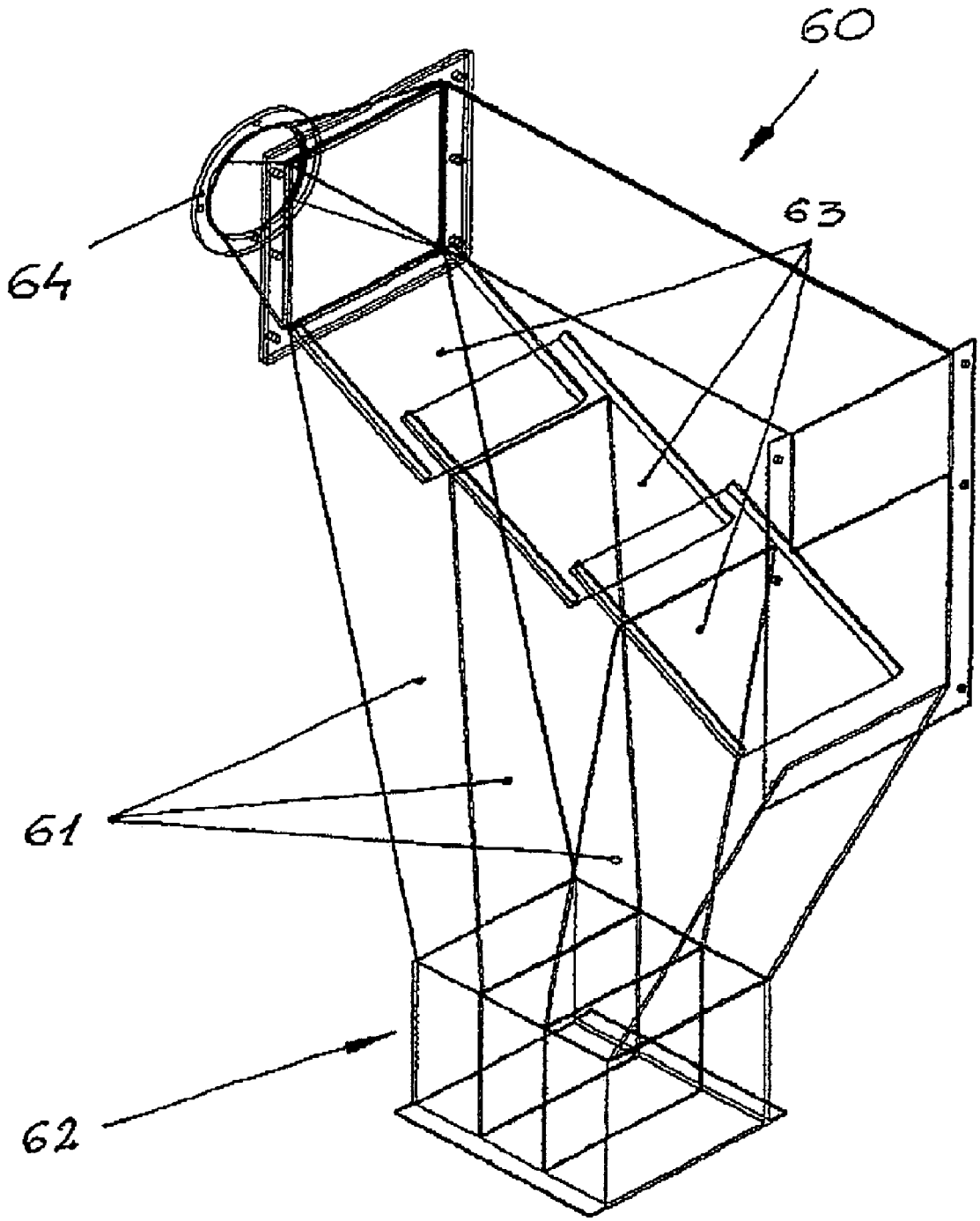
FIG. 6 is a perspective view of a lateral particle separator to be used with the apparatus of the second embodiment.

Referring to FIGS. 5 and 6, a lateral selector is generally shown at 60. The lateral selector 60 is positioned in the transfer chamber 30 of the transfer casing 13. Referring more specifically to FIG. 6 in which all reference numerals are shown to simplify FIG. 5, the lateral selector 60 is shown defining three upstanding sectors 61, each converging to a segmented outlet portion 62. Each of the sector 61 has a respective collecting surface 63 upon which particles coming from the dilution treatment chamber 12 will be collected. A flow of fluid outlet 64 is provided downstream of the upstanding sectors 61 to allow an appropriate flow of fluid, that will not impede on the lateral flow of fluid (or gaseous fluid) out of the lateral outlets 24 of the dilution treatment chamber 12.

More specifically, the lateral distributor 60 operates with the principle that the distance traveled by the particles transported in the flow of fluid from the dilution treatment chamber 12 is a function of the particle size parameters (e.g., surface area, mass) and the jet momentum of the flow of fluid. Accordingly, heavier mass of particles will travel a shorter distance than finer ones, whereby the coarser particles will be collected by the upstream sector 61. Therefore, a further particle group separation takes place with the lateral distributor 60. The hence separated particle groups are collected-separately at the segmented outlet portion 62.

Figure 7:
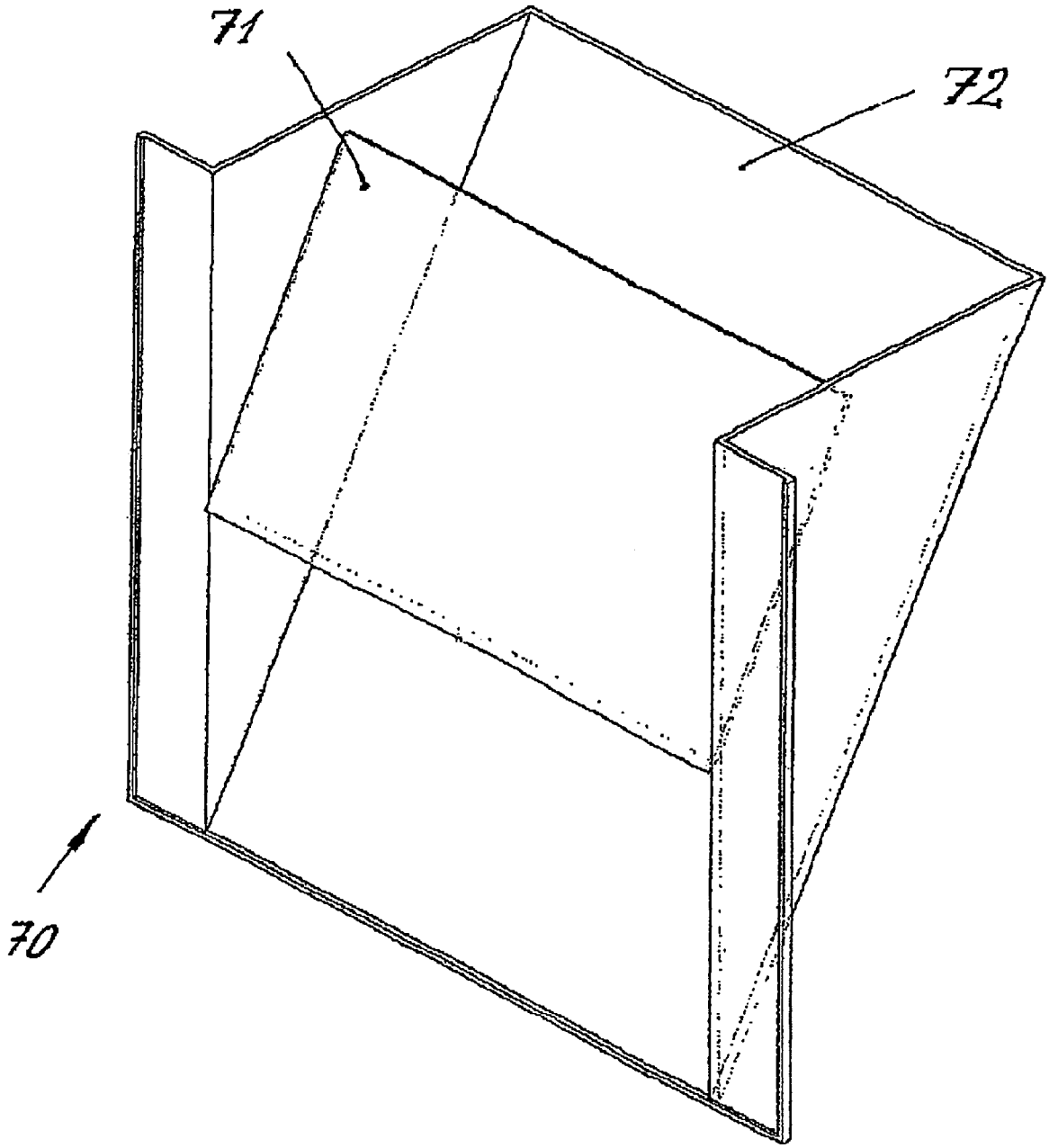
FIG. 7 is a perspective view of a recuperator tray of the apparatus.

Referring to FIGS. 3 and 7, recuperation trays 70 are provided below each of the transfer chamber apertures 24 of the dilution treatment chamber 12. More specifically, it is possible that particles groups should selectively remain with the dilution treatment chamber 12 are deflected out of the transfer chamber aperture 24. It is anticipated that these heavier groups of particles will not travel a long distance out of the transfer chamber aperture 24 due to their mass parameters and momentum. Accordingly, the recuperation trays 70 are provided to collect these particles, as they are positioned directly below the transfer chamber apertures 24. These particles are returned to the dilution treatment chamber 12 by the sloping shape of the recuperation trays 70.

Moreover, the recuperation tray 70 illustrated in FIG. 7 have various configurations also effects a particle separation. More specifically, the recuperation tray 70 as has a first sector 71 and a second sector 72. The first sector 71 collects the particles that should not have left the dilution treatment chamber 12, whereas the second sector 72 collects rapidly falling particles, of a grade just below that of the particle group remaining within the dilution treatment chamber 12. It is pointed out that the second sector 72 is connected to its own outlet.

Also, the recuperation tray 70 may be pivotally connected at a bottom edge thereof to the wall of the dilution treatment chamber 12. This would enable adjustment of an angle of the recuperation tray 70 with regard to the vertical, as a function of the particle stream/particle group being separated.

Figure 8:
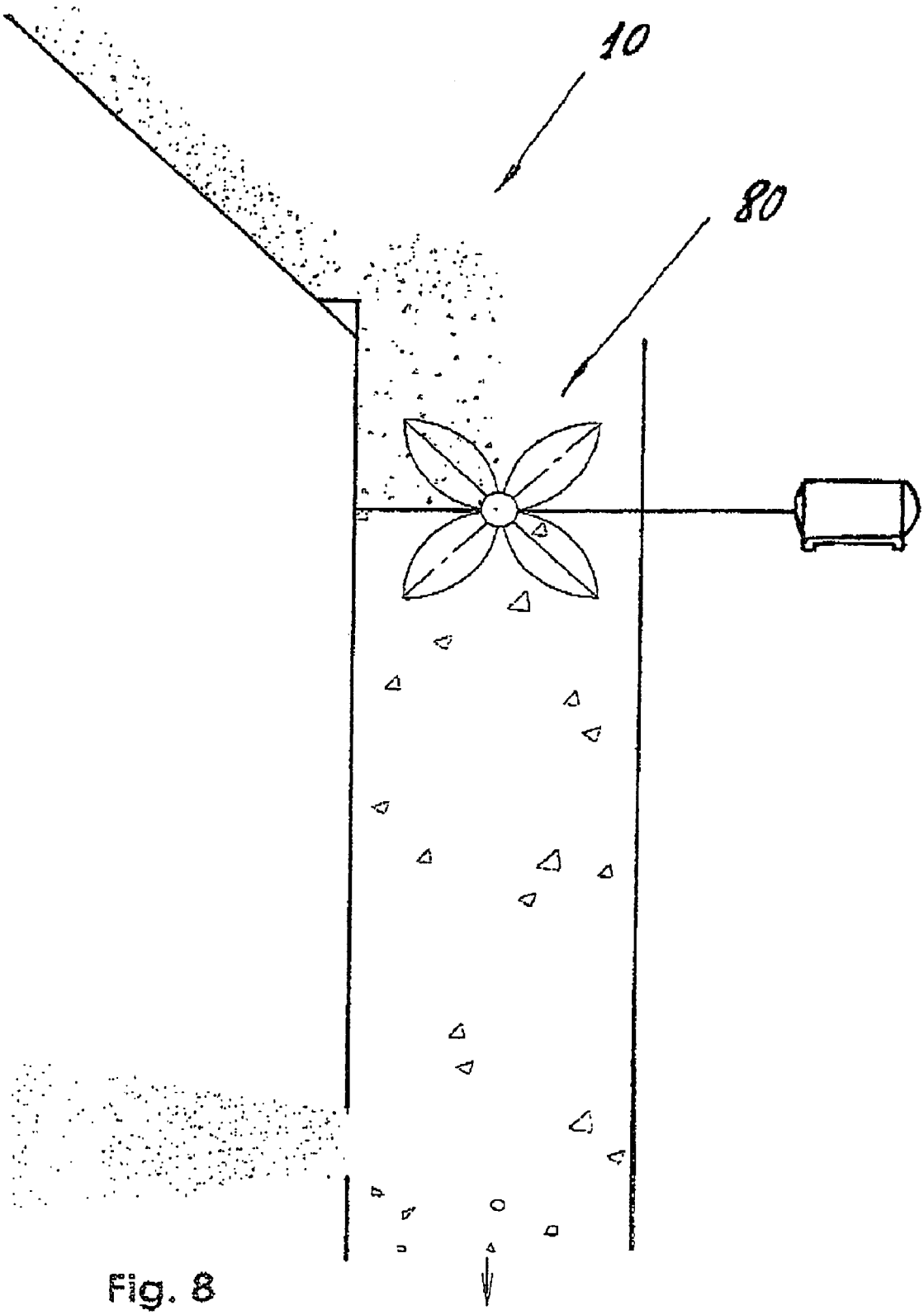
FIG. 8 is a schematic view of impeller used to create horizontal dilution of a particle stream in accordance with an alternative embodiment of the present invention.
Figure 9:
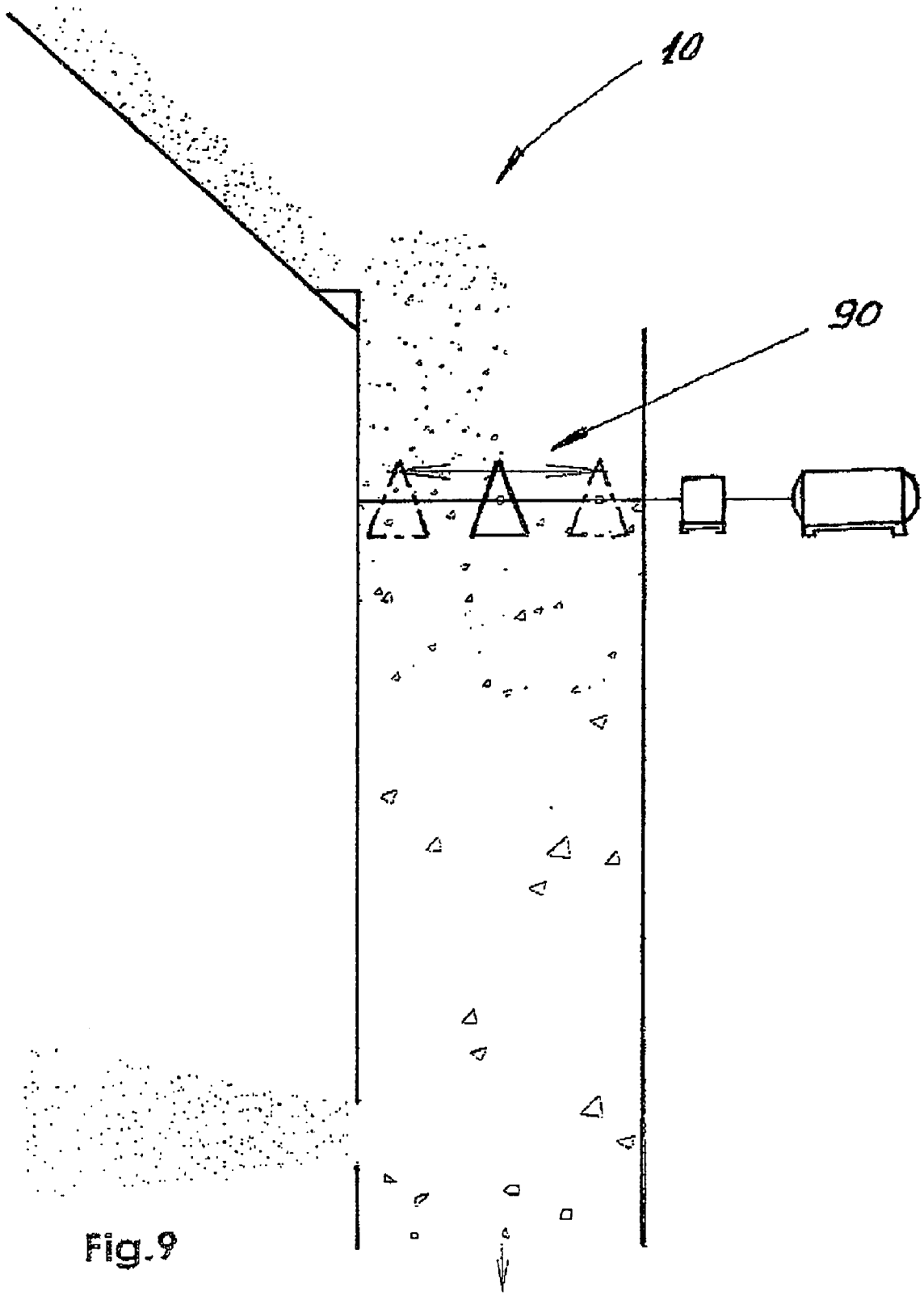
FIG. 9 is a schematic view of a laterally reciprocating strainer in accordance with a further alternative embodiment of the present invention.

FIG. 8 and 9 illustrate alternative of the nozzle 14A. In FIG. 8, an impeller is shown at 80. In FIG. 9, a laterally reciprocating strainer is generally shown at 90. Both these alternatives will cause a horizontal dilution of the particle stream. Other alternatives include, electrostatic or magnetic emitters (e.g., in accordance with the type of particles stream being treated), as well as any mechanical or ultrasound system.

It is also contemplated to inject additives to the particle stream being diluted in the dilution treatment chamber 12. For instance, an aperture such as one of the dilution treatment chamber pressure-differential apertures 25 can be used with a suitable injection system (e.g., pressure source and conduit combination) to inject any kind of treatment agent color (e.g., in the form of a powder) to the particle stream being diluted in the dilution treatment chamber 12, or to particle groups being treated therein.

It is also contemplated to provide a plurality of the apparatus 10 in series, with a conveying system transporting/conveying the output of an upstream one of the apparatus 10 to a downstream one. Alternatively, a pair (or more) of the apparatus 10 may be positioned in parallel and/or share a common transfer chamber 30, to collect a specific particle group. In such a case, the transfer chamber 13 could be used to treat a particles group from a first dilution treatment chamber 12 with particles group of a second dilution treatment chamber 12.

Figure 10:
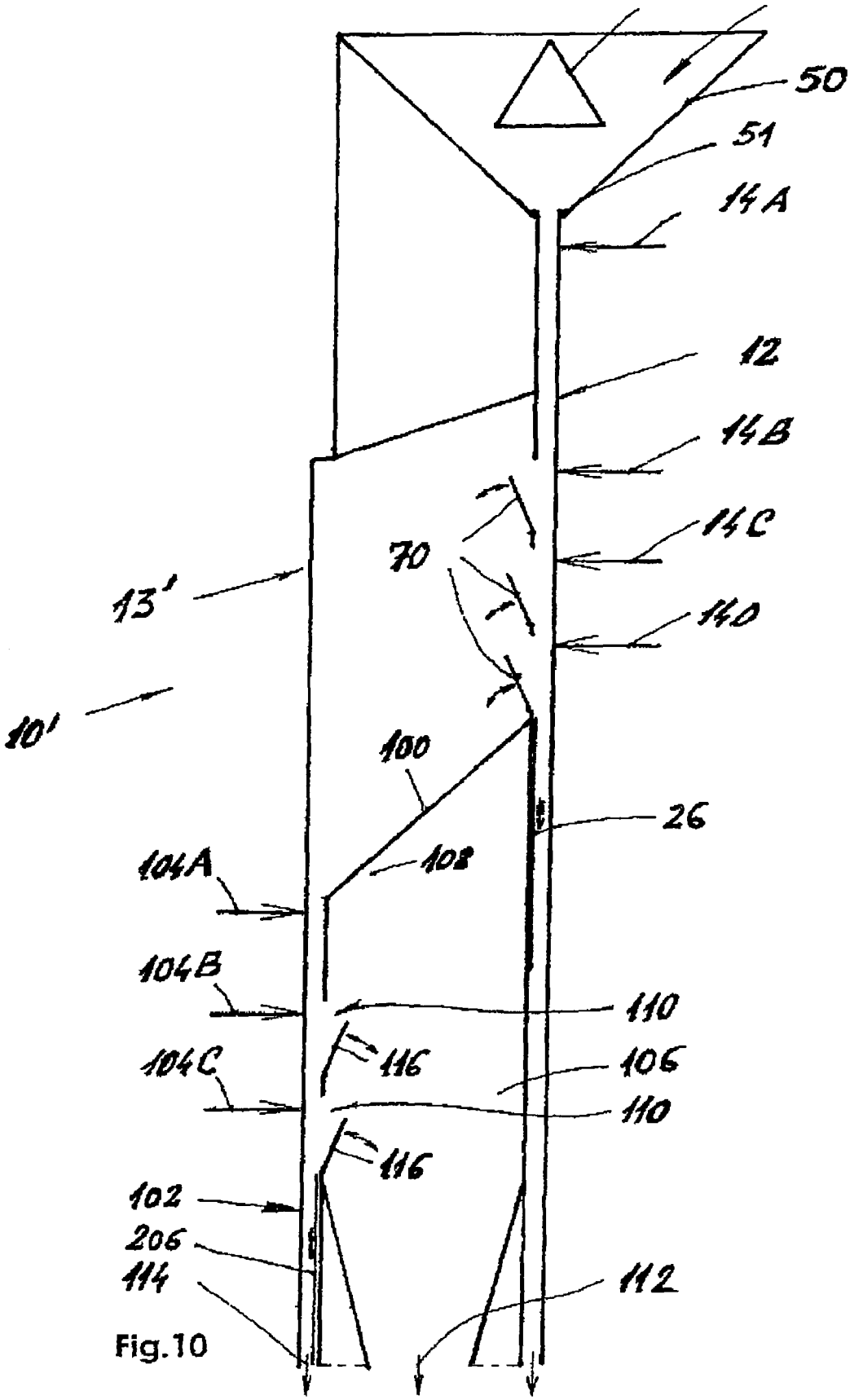
FIG. 10 is a schematic view of an apparatus for separating/treating particles stream in accordance with a still further alternative embodiment of the present invention.

For instance, referring to FIG. 10, an apparatus in accordance with an alternative embodiment of the present invention is generally shown at 10'. The apparatus 10' is similar to the apparatus 10 of FIG. 1 in that the apparatus 10' has a dilution treatment chamber 12, 102, nozzles 14, 104 (herein pluralities nozzles for the dilution treatment chamber 12, 102), and a pre-treatment module 15'. The pre-treatment module 15' shows a different shape (e.g., with a slide 55', but operates in a fashion similar to that of the pre-treatment module 15. The apparatus 10' has another transfer chamber casing 13' in which a secondary separation/treatment is performed.

More specifically, the transfer chamber casing 13' has a transfer plate 100, a dilution treatment chamber 102, nozzles 104, and another transfer chamber sub casing 106. The particles group reaching the transfer chamber casing 13' from the dilution treatment chamber 12 will drop into the inlet of the dilution treatment chamber 102, or will settle onto the transfer plate 100, to then reach the inlet of the dilution treatment chamber 102.

Optionally, the transfer plate 100 is provided with a vibrator 108 so as to avoid having particles collect thereon. The transfer plate 100 could also be provided with a low adherence coating, such as PTFE.

The dilution treatment chamber 102 is illustrated having the nozzles 104A, 104B, and 104C. The nozzle 104A serves the same function as the nozzle 14A of FIG. 1, namely to distribute the particles group that has reached the dilution treatment chamber 102. The nozzle 104A can be replaced with other devices, such as those illustrated in FIGS. 8 and 9.

The nozzles 104B and 104C serve the same function as the nozzles 14B and 14C of FIG. 1, and are thus positioned opposite the transfer aperture 110, through which a particle group will be forced out, to reach the transfer chamber sub casing 106 and settle therein. The removed particles group will exit through outlet 112, whereas the remaining particles group in the dilution treatment chamber 102 will exit through dilution treatment chamber outlet 114. Recuperation trays 116 are adjustable similarly to the recuperation trays 70 of the preferred embodiment.

Accordingly, the output of the apparatus 10' have many particles groups, with particles group exiting from the passageway outlet 20, 102, and transfer chamber outlet 112. It is pointed out that the gaseous fluid magnitude output at the nozzles 14 and 104 is adjusted in view of the desired mass of the particles groups. The transfer chamber casing 13' can be used for separating or treating, as described previously for the apparatus 10.

Amongst the various process that can take place with the apparatus (10-10') of the present invention, it is contemplated to separate, treat, classify (with an initial step of separation), add, vaporize, clean, calibrate, or eliminate group of fines particles from particle streams. Other treatments, such as painting, coating, sandblasting, cleaning, and so forth can be effected with the apparatus 10-10' of the present invention. Existing batch processes, such as the injection of gas or chemicals into soft drinks, can be converted to continuous processes using the present invention.

The differential pressure in the dilution treatment chamber 12 can be controlled electronically and the apparatus 10 may be combined to magnetic, electrical, ultrasound, electronic, and electromagnetic systems.

The apparatus 10-10' can be used with mineral, vegetable, biological, or organic aggregates, as well as with fertilizers, treatment or transformation residues, waste, food products, drugs and other pharmaceutical products, powders, agriculture related products, chemical or metallurgical products, compost, plastics and composites, paper, soil and bio-soil, ashes, crushed stone, ceramics, coal.

The apparatus 10-10' of the present invention is relatively small. Accordingly, it is possible to place the apparatus 10-10' at various parts of a process due to these advantageous features. The apparatus 10-10' enables large quantities of particle fluid streams to be treated in a relatively limited amount of space, with little wear of material, low energy consumption and, in some embodiments, no moving parts (i.e., depending on the choice of the type of dilution).

The apparatus 10-10' can be used as part of a multi-step or multi-pass process. For instance, the preferred embodiment includes a settling cavity for the collection of particles. The apparatus 10-10' is made of rigid materials, such as metals, polymers, and so forth. It is pointed out that aside from the slide 53, the apparatus 10-10' goes through limited wear.

It is within the ambit of the present invention to cover any obvious modifications of the embodiments described herein, provided such modifications fall within the scope of the appended claims.

I claim:

1. An apparatus for separating a particle stream into a first particle group and a second particle group, said apparatus being connectable to a positive pressure source, said apparatus comprising:

a dilution treatment chamber defining a passageway, said passageway being substantially upstanding and defining a passageway top end and a substantially opposed passageway bottom end, said passageway top end defining a particle inlet and said passageway bottom end defining a first-particle-group outlet for releasing the first particle group, said passageway being configured and sized to receive the particle stream at said particle inlet such that the particle stream falls toward said first-particle-group outlet;

a transfer casing located substantially adjacent to said dilution treatment chamber, said transfer casing defining a transfer chamber provided for receiving the second particle group;

at least one transfer aperture substantially laterally positioned with respect to said passageway, said transfer aperture extending between said transfer chamber and said passageway and allowing fluid communication therebetween, said at least one transfer aperture including an uppermost transfer aperture, said passageway and said transfer chamber being separated from each other by a wall above said uppermost transfer aperture for preventing said particles from said particle stream falling in said passageway from entering said transfer chamber above said uppermost transfer aperture;

a distributor located in said passageway between said particle inlet and said transfer aperture, said distributor being provided for substantially breaking down the particle stream and distributing the particle stream substantially horizontally within said passageway, said distributor including a fluid-injection nozzle defining a distributor aperture laterally positioned in said passageway, said distributor aperture being located above said uppermost transfer aperture, said fluid-injection nozzle being connectable to the positive pressure source for injecting a jet of the fluid in said passageway through the distributor aperture for distributing the particle stream over a surface area of said passageway; and at least one fluid flow aperture provided in said dilution treatment chamber for creating a substantially horizontal fluid flow in said passageway, said at least one fluid flow aperture and said transfer aperture being located below said distributor substantially horizontally aligned relatively to each other and located substantially opposed to each other relatively to said passageway, said fluid flow aperture being connectable to the positive pressure source to create the fluid flow;

whereby the fluid flow pushes the second particle group out of said passageway through said transfer aperture and into said transfer chamber with the first particle group remaining in said passageway for exiting through said first-particle-group outlet.

2. The apparatus according to claim 1, further comprising a pre-treatment module located substantially above said particle inlet, to guide the particle stream and to cause a horizontal dilution of the particle stream.

3. The apparatus according to claim 2, wherein said pre-treatment module has at least one slide portion sloping downwardly toward said particle inlet for guiding and accelerating the particle stream towards said dilution treatment chamber, and a deflecting surface located between said slide and said particle inlet for breaking down the particle stream and for imparting the dilution to the particle stream.

4. The apparatus according to claim 1, wherein at least one of said fluid flow apertures is usable to inject a fluid additive into the particle stream.

5. The apparatus according to claim 1, wherein said dilution treatment chamber and said transfer casing share a wall separating said passageway and said transfer chamber from each other.

6. The apparatus according to claim 5, wherein said fluid flow aperture is defined by at least one separation nozzle provided for projecting a fluid jet, said separation nozzle including an adjustable gate selectively movable across said fluid flow aperture for controlling a rate and pressure of the fluid jet projected from said fluid flow aperture.

7. The apparatus according to claim 1, wherein said fluid-injection nozzle tapers in a direction leading towards said distributor aperture substantially adjacent said distributor aperture.

8. The apparatus according to claim 1, wherein said distributor aperture is substantially rectangular and oriented such that said distributor aperture extends over a greater extent horizontally than vertically.

9. The apparatus according to claim 1, further comprising a recuperation tray, positioned within said transfer chamber below said transfer aperture for collecting particles of the first particle group deflected or forced out of said passageway by the flow of fluid, and for returning the collected particles towards said passageway, in the remainder of the particle stream.

10. The apparatus according to claim 1, wherein said transfer chamber has an outlet at a bottom end thereof, for collecting the second particle group received in said transfer casing.

11. The apparatus according to claim 1, wherein said transfer chamber is segmented into laterally adjacent upstanding receptacles to further separate the second particle group according to the distance over which the particles of the second particle group are entrained by the flow of fluid.

12. An apparatus according to claim 1, wherein said passageway has a substantially parallelepipedic configuration.

13. An apparatus according to claim 12, wherein said wall is substantially horizontally movable so as to allow a variation in a cross-sectional area of said passageway.

* * * * *